US008733124B2

(12) United States Patent
Kim

(10) Patent No.: US 8,733,124 B2
(45) Date of Patent: May 27, 2014

(54) REFRIGERATOR HAVING QUICK CHILLING COMPARTMENT

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 1200 days.

(21) Appl. No.: 12/634,509

(22) Filed: Dec. 9, 2009

(65) Prior Publication Data

US 2010/0175403 A1 Jul. 15, 2010

Related U.S. Application Data

(60) Provisional application No. 61/145,030, filed on Jan. 15, 2009.

(51) Int. Cl.
*F25D 17/04* (2006.01)

(52) U.S. Cl.
USPC ..... 62/407; 62/62; 62/440; 62/441

(58) Field of Classification Search
USPC ..... 62/62, 407, 440, 441
See application file for complete search history.

(56) References Cited

U.S. PATENT DOCUMENTS

| | | | | |
|---|---|---|---|---|
| 4,358,932 | A * | 11/1982 | Helfrich, Jr. | 62/126 |
| 6,044,659 | A * | 4/2000 | Ji | 62/408 |
| 7,096,936 | B1 * | 8/2006 | Chastine et al. | 165/253 |
| 7,942,012 | B2 * | 5/2011 | Ritchie et al. | 62/115 |
| 2006/0277269 | A1 * | 12/2006 | Dent et al. | 709/217 |
| 2007/0151284 | A1 * | 7/2007 | Freesmeier et al. | 62/419 |
| 2009/0044549 | A1 * | 2/2009 | Sundhar | 62/125 |

* cited by examiner

*Primary Examiner* — Marc Norman
*Assistant Examiner* — Jonathan Bradford
(74) *Attorney, Agent, or Firm* — Birch, Stewart, Kolasch & Birch, LLP

(57) ABSTRACT

Provided is a refrigerator. The refrigerator includes a main body defining a storage compartment and a door for opening or closing the storage compartment. A quick-freezer for cooling a drink at a temperature lower than that of the storage compartment is provided in the storage compartment.

8 Claims, 7 Drawing Sheets

REFRIGERATOR HAVING QUICK CHILLING COMPARTMENT

This Non-Provisional application claims priority under 35 U.S.C. 119(e) on U.S. Provisional Application No. 61/145,030, filed on Jan. 15, 2009, the entire contents of which are hereby incorporated by reference.

BACKGROUND

Embodiments relate to a refrigerator.

Generally, a refrigerator is an appliance that can store foods at a low temperature using cool air supplied into a storage compartment.

The refrigerator includes a main body defining the storage compartment and a door moveably coupled to the main body to open or close the storage compartment.

The storage compartment may include a freezer compartment and a refrigerator compartment. The door may include a freezer compartment door for opening or closing the freezer compartment and a refrigerator compartment door for opening or closing the refrigerator compartment.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
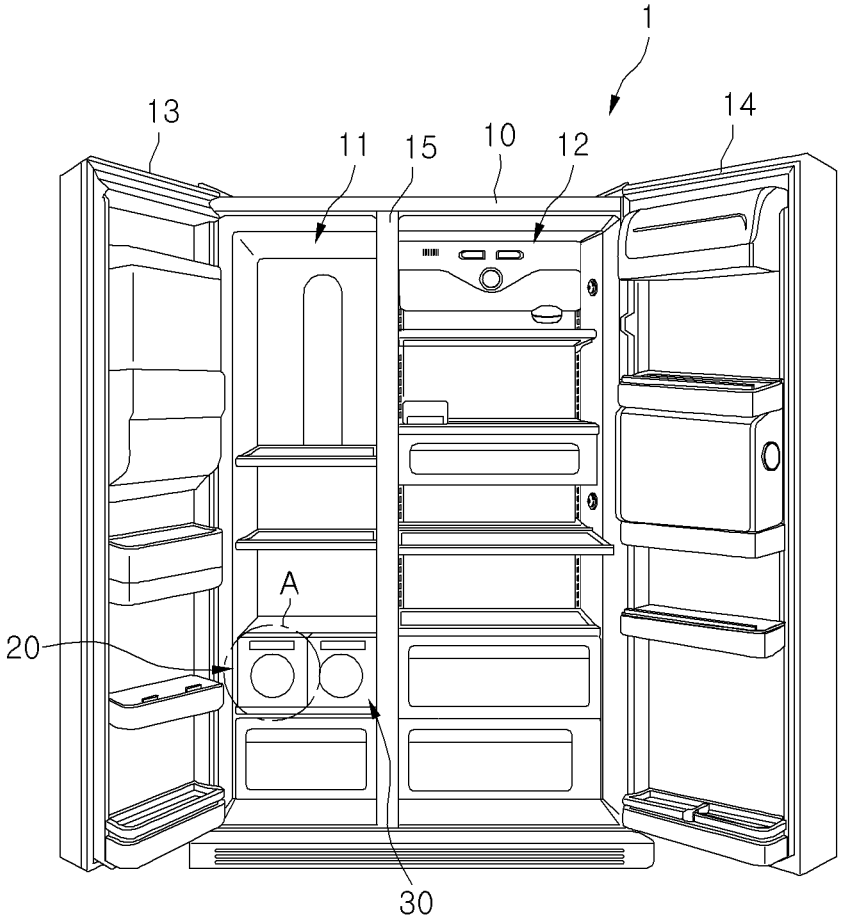
FIG. 1 is a perspective view illustrating a structure of a storage compartment of a refrigerator according to an embodiment.

FIG. 1 is a perspective view illustrating a structure of a storage compartment of a refrigerator according to an embodiment.

Although a side by side type refrigerator in which a refrigerator compartment and a freezer compartment are respectively disposed in left and right sides is illustrated in FIG. 1 as an example, the present disclosure is not limited thereto. For example, a refrigerator according to this embodiment may be applied to following various refrigerators: a top mount type refrigerator in which a refrigerator compartment is disposed under a freezer compartment; and a bottom freezer type refrigerator in which a refrigerator compartment is disposed above a freezer compartment.

Referring to FIG. 1, a refrigerator 1 according to this embodiment includes a main body 10 defining a storage compartment and a refrigerator door moveably coupled to the main body 10 to open or close the storage compartment.

The storage compartment includes a freezer compartment 11 and a refrigerator compartment 12. A barrier 15 divides the inside of the main body 10 into left and right sides to define a freezer compartment 11 and a refrigerator compartment 12.

The refrigerator door includes a freezer compartment door 13 for opening or closing the freezer compartment 11 and a refrigerator compartment door 14 for opening or closing the refrigerator compartment 12.

One or more quick-freezers 20 and 20 for cooling a drink at a temperature lower than that of the freezer compartment 11 are provided inside the freezer compartment 11. Two quick-freezers (a first quick-freezer 20 and a second quick-freezer 30) that are disposed at left and right sides with respect to each other will be described in FIG. 1 as an example.

The quick-freezers 20 and 30 quickly cools the drink at an extremely low temperature, e.g., several tens degrees of frost (for example, 35° C. of frost). In this embodiment, the extremely low temperature denotes a temperature lower than that of the freezer compartment, and also, does not denote only a temperature below 90K that is a boiling point of liquid oxygen used in academic circles.

Figure 2:
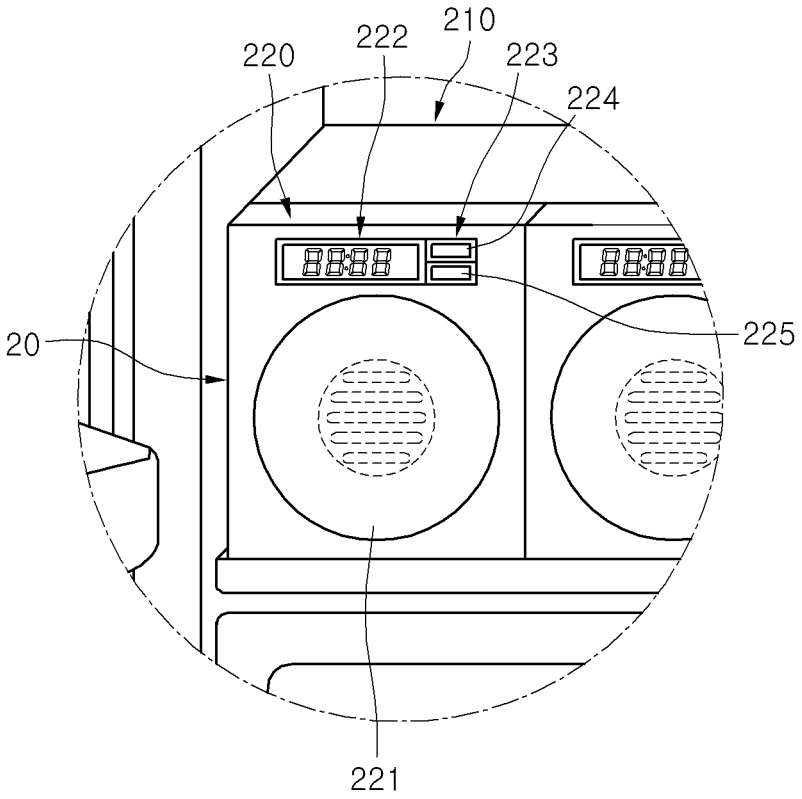
FIG. 2 is a partial enlarged view illustrating a portion "A" of FIG. 1.
Figure 3:
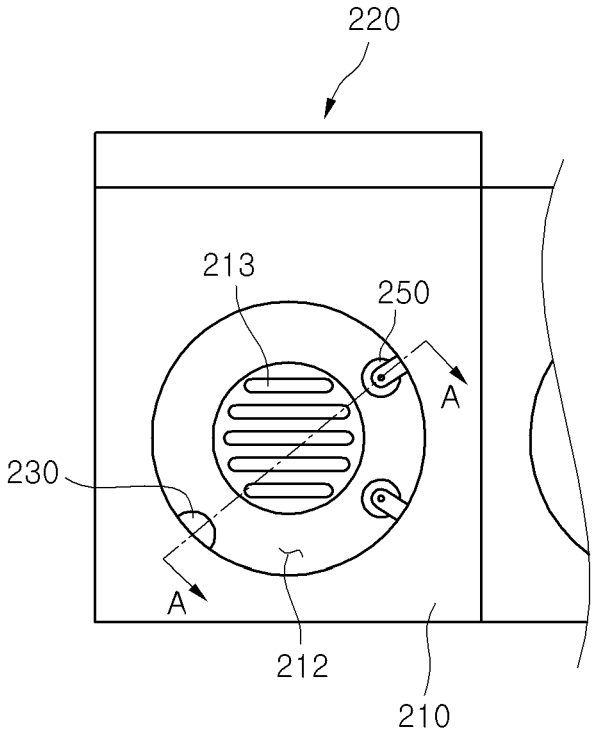
FIG. 3 is a view of a state in which a door of a quick-freezer is opened according to an embodiment.
Figure 4:
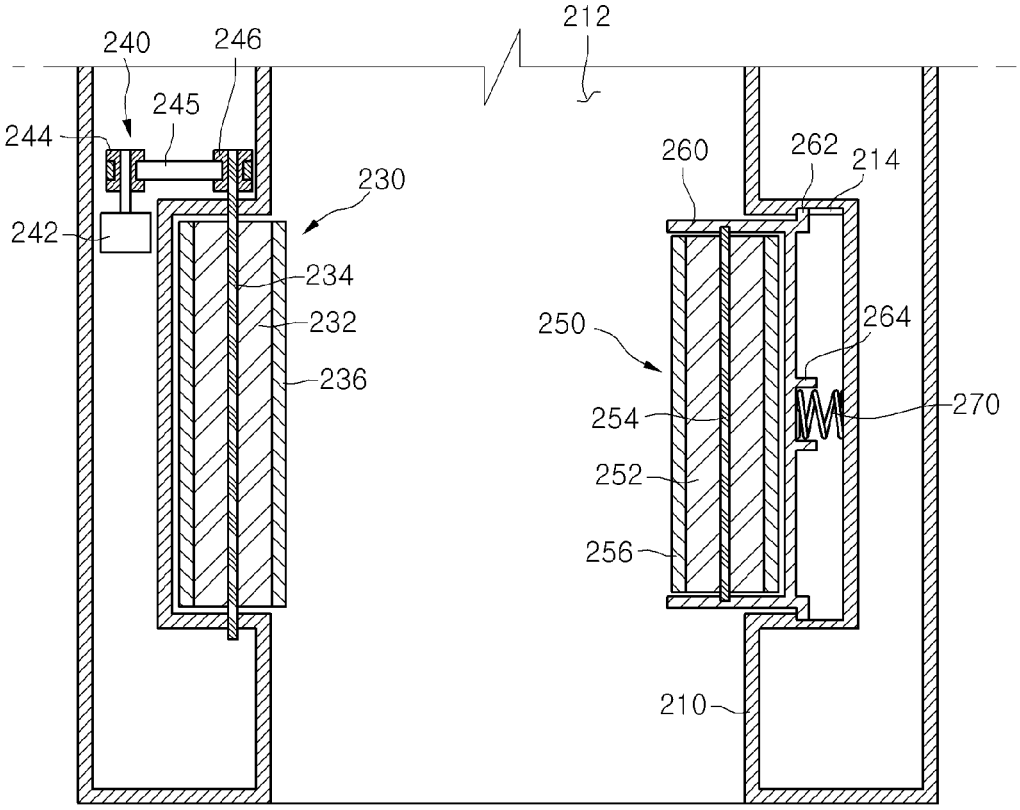
FIG. 4 is a cross-sectional view taken along line A-A of FIG. 3.

FIG. 2 is a partial enlarged view illustrating a portion "A" of FIG. 1, FIG. 3 is a view of a state in which a door of a quick-freezer is opened according to an embodiment, and FIG. 4 is a cross-sectional view taken along line A-A of FIG. 3.

In this embodiment, the plurality of quick-freezers has the same structure as each other except for a position thereof. Thus, only the first quick-freezer 20 will now be described. In addition, the first quick-freezer 20 is referred to as a "quick-freezer 20".

Referring to FIGS. 2 to 4, the quick-freezer 20 according to this embodiment includes a casing 210, a door 220, and a rotation device. The casing 210 defines an extremely low temperature storage chamber 212. The door 220 is rotatably coupled to the casing 210 to open or close the extremely low temperature storage chamber 212. The rotation device rotates drinks received in the extremely low temperature storage chamber 212.

In detail, for example, articles received in the extremely low temperature storage chamber 212 may include the drinks. The drinks may include a milk, a beer, and a wine. In this embodiment, the articles received in the extremely low temperature storage chamber 212 are not limited to the drinks.

The door 220 includes an input part for manipulating an operation of the quick-freezer 20 and a display part 222 on which an operation state of the quick-freezer 20 is displayed.

The input part 223 may include an operation button 224 for operating the quick-freezer 20 and a time button 225 for adjusting an operation time (cool air supply time) of the quick-freezer 20. When the operation button 224 is selected, air passing through an evaporator (not shown) may be introduced into the extremely low temperature storage chamber 212, and the rotation device may operate. Here, in case where one evaporator is provided in the main body 10, the air passing through the evaporator may be supplied into the extremely low temperature storage chamber 212. In case where a freezer compartment-side evaporator and a refrigerator compartment-side evaporator are separately provided in the main body 10, air passing through the freezer compartment-side evaporator may be supplied into the extremely low temperature storage chamber 212.

The door 220 includes a transparent window 221 through which the extremely low temperature storage chamber 212 can be viewed in a state where the door 220 close the extremely low temperature storage chamber 212.

The casing 210 includes an inlet port 213 through which the air passing through the evaporator (not shown) is introduced.

The rotation device rotates the articles received in the extremely low temperature storage chamber 212, e.g., the drinks to uniformly quickly cool the drinks.

The rotation device includes a first rotation member 230, a drive unit 240, and at least two second rotation members 250. The first rotation member 230 is rotatably coupled to the casing 210. The drive unit 240 drives the first rotation member 230. The second rotation members 250 are in contact with the drinks received in the extremely low temperature storage chamber 212 to generate a frictional rolling movement.

The first rotation member 230 includes a first rotation body 232 having a first rotation shaft 234 and a first body cover 236 provided inside the first rotation body 232 to increase a friction force with the drinks. The first body cover 236 may be formed of an elastically deformable material, e.g., a rubber. The first rotation shaft 234 is coupled to the casing 210.

The drive unit 240 includes a motor 242 generating a driving force, and a transmission unit transmitting the driving force of the motor 242 to the first rotation shaft 234.

The transmission unit includes a first pulley 244, a second pulley 246, and a transmission belt 245. The first pulley 244 is connected to the motor 242. The second pulley 246 is coupled to a side of the first rotation shaft 234. The transmission belt winds around the first pulley 244 and the second pulley 246 to transmit a rotary force of the first pulley 244 to the second pulley 245.

Although the driving force of the motor 242 is transmitted to the first rotation shaft 234 using the pulleys 244 and 246 and the belt 245, the present disclosure is not limited thereto. For example, the rotation shaft may directly rotate by the motor 242. Also, a structure of the transmission unit is not limited in this embodiment.

The plurality of second rotation members 250 is spaced from each other.

Each of the second rotation members 250 includes a second rotation body 252 having a second rotation shaft 254 and a second body cover 256 provided inside the second rotation body 252 to increase the friction force with the drinks. The second body cover 256 may be formed of an elastically deformable material, e.g., a rubber.

Each of the second rotation members 250 is coupled to a support member 260 and supported by the support member 260. The support member 260 is elastically supported by an elastic member 270.

The second rotation shaft 254 is freely rotatably coupled to the support member 260. A seating rib 264 on which the elastic member 270 is seated is disposed on the support member 260.

Guide ribs 262 for guiding a movement of the support member 260 protrude from both side surfaces of the support member 260. The guide ribs 262 are received into the casing 210. Guide grooves 214 for guiding movements of the guide ribs 262 are provided in the casing 210.

A limitation of the movement of the support member 260 may be set by the guide grooves 214 and the guide ribs 262.

Thus, since the support member 260 can be translated by the elastic member 270, the second rotation member 260 can be in contact with the drinks even through the drinks received in the extremely low temperature storage chamber 212 are different in size.

Thus, the plurality of second rotation members 250 is in contact with the drinks to support the drinks, and simultaneously, smoothly rotates the drinks due to a friction effect therebetween.

Figure 5:
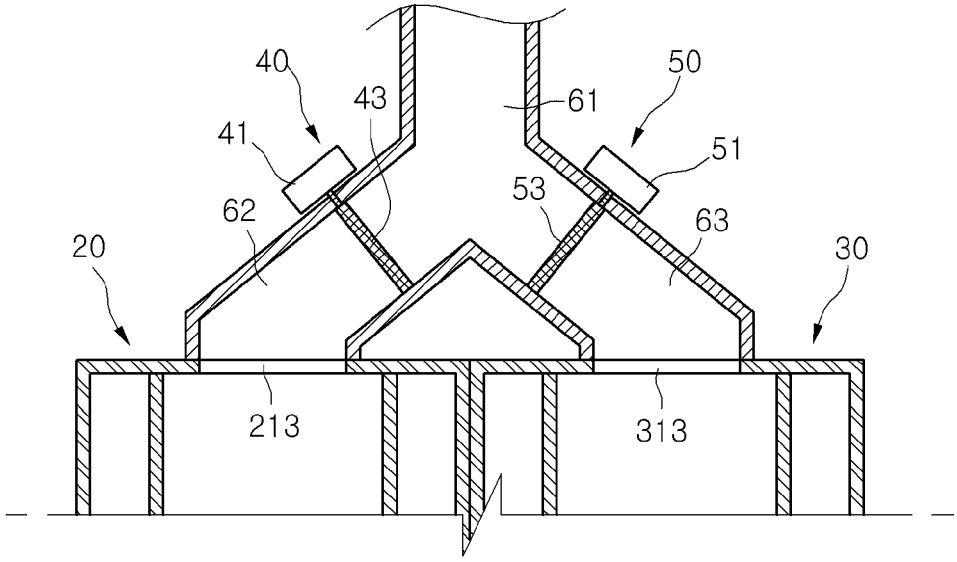
FIG. 5 is a view of a structure in which cool air is supplied into a plurality of quick-freezers according to an embodiment.

FIG. 5 is a view of a structure in which cool air is supplied into a plurality of quick-freezers according to an embodiment.

Referring to FIG. 5, the plurality of quick-freezers 20 and 30 is disposed in left and right direction with respect to each other as described above.

The main body 10 includes a main passage 61, a first branch passage 62, and a second branch passage 63. The main passage 61 communicates with a chamber in which the evaporator (not shown) is received. The first branch passage 62 and the second branch passage 63 are branched from the main passage 61.

The branch passages 62 and 63 selectively communicate with inlet ports 213 and 313 of the quick-freezers 20 and 30 by opening and closing devices 40 and 50, respectively. Each of the opening and closing devices 40 and 50 includes motors 41 and 51 and opening and closing members 43 and 53 respectively connected to the motors 41 and 51. Each of the opening and closing devices 40 and 50 independently operates.

Hereinafter, an operation process of the quick-freezer according this embodiment will be described.

Figure 6:
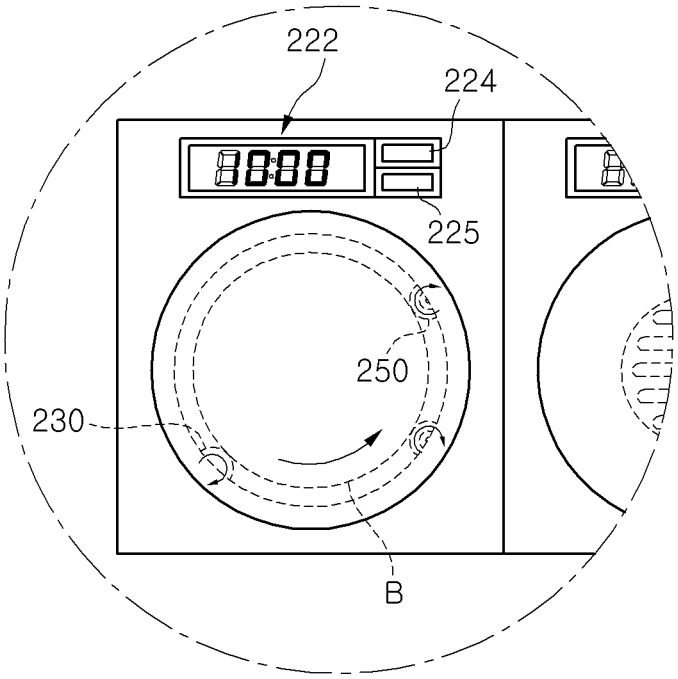
FIG. 6 is a view illustrating an operation process of a quick-freezer according to an embodiment.

FIG. 6 is a view illustrating an operation process of a quick-freezer according to an embodiment.

An operation process of the first quick-freezer will be described in FIG. 6 as an example.

Referring to FIGS. 1 to 6, in order to quickly cool the drinks using the first quick-freezer 20, first, the door 220 is opened. Then, a drink B required to be quickly cooled is received into the extremely low temperature storage chamber 212. Then, the door 220 is closed. A user manipulates the time button 225 to select the supply time of the cool air. Thereafter, the operation button 224 is selected. Here, a time (for example, ten minutes) selected by the user is displayed on the display part 222.

When the operation button 224 is selected, the main passage communicates with the inlet port 213 by the opening and closing device 40 to supply the cool air to the extremely low temperature storage chamber 212. Also, when the operation button 224 is selected, the drive unit 240 operates, and thus, the first rotation member 230 rotates in a direction (a clockwise direction when viewed in FIG. 6).

As a result, the drink B rotates in a counter-clockwise direction. At this time, since the plurality of second rotation members 250 is in contact with the drink B, the plurality of second rotation members 250 rotates in a direction (clockwise direction) opposite to that of the drink B due to the rotation of the drink B.

When the time inputted by the user passes, the operation of the drive unit 240 is stopped. The opening and closing device 40 interrupts the communication between the inlet port 213 and the main passage 61. At this time, when the time inputted by the user passes, a signal that notifies quick-freezing completion may be generated to the outside. For example, a buzzer circuit or a speaker for generating the signal may be provided in the door 220.

According to this embodiment, since the separate extremely low temperature storage chamber in addition to the freezer compartment and the refrigerator compartment is provided, usefulness of the refrigerator can be improved.

Also, since the drinks can be stored in the extremely low temperature storage chamber 212 for a predetermined time, the drinks can be further quickly cooled.

In addition, since the drinks received in the extremely low temperature storage chamber 212 rotates by the rotation device, the drinks can be quickly cooled.

Although not shown in this embodiment, an insulating material for insulating the freezer compartment 11 from the extremely low temperature storage chamber 212 may be provided in the casing 210.

Although the extremely low temperature storage chamber 212 communicates with the chamber in which the evaporator is disposed in this embodiment, the present disclosure is not limited thereto. For example, the freezer compartment 11 may communicate with the extremely low temperature storage chamber 212.

Figure 7:
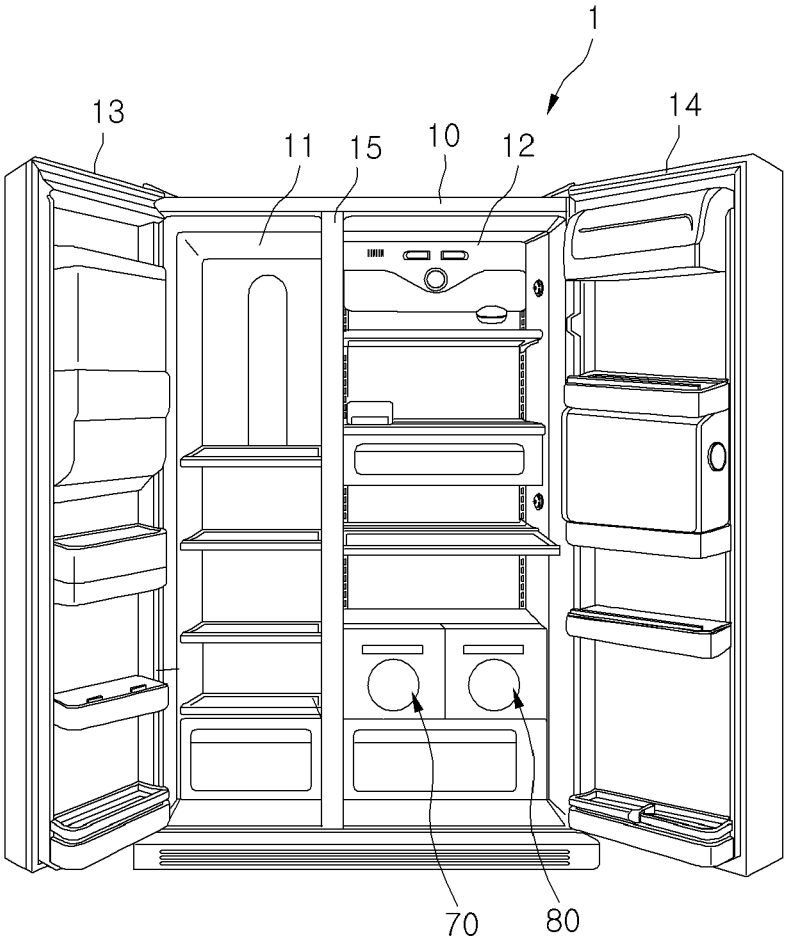
FIG. 7 is a perspective view illustrating a structure of a storage compartment of a refrigerator according to another embodiment.

FIG. 7 is a perspective view illustrating a structure of a storage compartment of a refrigerator according to another embodiment.

This embodiment is almost the same as the previous embodiment but only different from the previous embodiment in a position of a quick-freezer. Therefore, only characteristics parts of this embodiment will be described below.

Referring to FIG. 7, quick-freezers 70 and 80 according to this embodiment are provided in a refrigerator compartment 12. Alternatively, the quick-freezers 70 and 80 may be provided in a freezer compartment 11 and the refrigerator compartment 12, respectively.

Here, in case where one evaporator is provided in a main body 10, air passing through the evaporator may be supplied into the quick-freezers 70 and 80. In case where a freezer compartment-side evaporator and a refrigerator compartment-side evaporator are separately provided in the main body 10, air passing through the freezer compartment-side evaporator may be supplied into the quick-freezers 70 and 80.

What is claimed is:

1. A refrigerator comprising:

a body having a storage compartment;

a door mounted to the body to open and close the storage compartment;

a container cooling compartment located in the storage compartment, the container cooling compartment including:

a housing having an opening to receive a container to be cooled;

a driving unit to rotate the container received in the housing; and a door to open and close the housing, the door having a transparent window to see the container;

a cooling mechanism including a cooling air passage connected from an evaporator to the housing to provide cooling air flow into the housing;

an opening and closing member configured to open and close the cooling air passage; and a control unit configured to control the opening and closing member and the driving unit, wherein the control unit includes:

a display unit to display an operational status of the container cooling compartment;

an operational input unit that operates the opening and closing member and the driving unit; and a timer input unit configured to adjust an operation time of the opening and closing member and the driving unit, and wherein the driving unit comprises:

a first rotatable member rotating on a first axis;

a second rotatable member rotating on a second axis;

a support member received on the housing, the second rotatable member rotatably coupled to the support member;

at least one guide rib for guiding movement of the support member;

at least one guide groove positioned on the housing for guiding movement of the at least one guide rib; and an elastic member positioned between the support member and the housing to elastically support the support member.

2. The refrigerator of claim 1, wherein the cooling mechanism includes a motor connected to the opening and closing member, the motor being configured to rotate the opening and closing member to open and close the cooling air passage.

3. The refrigerator of claim 1, wherein the container cooling compartment includes:

an inlet in the housing, the inlet being connected to the cooling air passage; and an outlet configured to allow the cooling air flow to leave the housing.

4. The refrigerator of claim 3, wherein the outlet is located in the compartment door of the container cooling compartment.

5. The refrigerator of claim 1, wherein the second rotatable member is moveably supported such that the second rotatable member is movable toward and away from the first rotatable member to accommodate various sized containers.

6. The refrigerator of claim 1, wherein the body includes a freezer compartment and a refrigerator compartment, and wherein the container cooling compartment is located in one of the freezer compartment and the refrigerator compartment.

7. The refrigerator of claim 5, wherein the container cooling compartment includes a third rotatable member having a third axis, the third rotatable member being moveably supported such that the third rotatable member is movable toward and away from the first rotatable member to accommodate various sized containers.

8. The refrigerator of claim 7, wherein the first axis, second axis, and third axis are parallel to each other.

* * * * *